US008074475B2

(12) United States Patent
Lyu et al.

(10) Patent No.: US 8,074,475 B2
(45) Date of Patent: Dec. 13, 2011

(54) HEATER APPARATUS FOR WASHING MACHINE

(75) Inventors: Jae-Cheol Lyu, Changwon-si (KR); Dong-Yoon Kim, Changwon-si (KR); Sang-Gyu Lim, Daegoo-si (KR); Jong-Sun Yoon, Jinjoo-si (KR); Chang-Woo Son, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 589 days.

(21) Appl. No.: 11/916,343

(22) PCT Filed: Jun. 2, 2006

(86) PCT No.: PCT/KR2006/002138

§ 371 (c)(1),
(2), (4) Date: Nov. 10, 2008

(87) PCT Pub. No.: WO2007/001123

PCT Pub. Date: Jan. 4, 2007

(65) Prior Publication Data

US 2009/0126415 A1 May 21, 2009

(30) Foreign Application Priority Data

Jun. 3, 2005 (KR) ..... 10-2005-0047896

(51) Int. Cl.
*D06F 39/04* (2006.01)

(52) U.S. Cl. ..... 68/15; 68/142

(58) Field of Classification Search ..... 68/15, 23 R, 68/142

See application file for complete search history.

(56) References Cited

U.S. PATENT DOCUMENTS

| | | | | |
|---|---|---|---|---|
| 3,750,429 | A * | 8/1973 | Gorsuch | 68/12.22 |
| 6,553,594 | B2 * | 4/2003 | Broker et al. | 8/158 |
| 7,913,523 | B2 * | 3/2011 | Lyu et al. | 68/15 |
| 2004/0083770 | A1 * | 5/2004 | Lyu | 68/15 |
| 2005/0279141 | A1 * | 12/2005 | Kim | 68/12.22 |
| 2008/0011023 | A1 * | 1/2008 | Kim | 68/15 |

FOREIGN PATENT DOCUMENTS

| | | |
|---|---|---|
| GB | 1161215 | 8/1969 |
| GB | 2080343 | 2/1982 |
| JP | 4-112392 | 9/1992 |
| JP | 2005-512742 | 5/2005 |
| WO | WO 03056093 A1 * | 7/2003 |

OTHER PUBLICATIONS

Japanese Office Action issued in JP Application No. 2008-514558 dated Apr. 26, 2011.

* cited by examiner

*Primary Examiner* — Joseph L Perrin
(74) *Attorney, Agent, or Firm* — KED & Associates, LLP

(57) ABSTRACT

A heater apparatus of a washing machine is presented. The presented heater apparatus of a washing machine is comprising; a tub (190); a heater joint unit formed on the tub (190); a heater (200) arranged on the heater joint unit; and a heater joint member (300) being able to offset the pressure inflicted to the heater joint unit by the arrangement of the heater (200) as pressurizes the heater joint unit.

9 Claims, 4 Drawing Sheets

[Fig. 1]
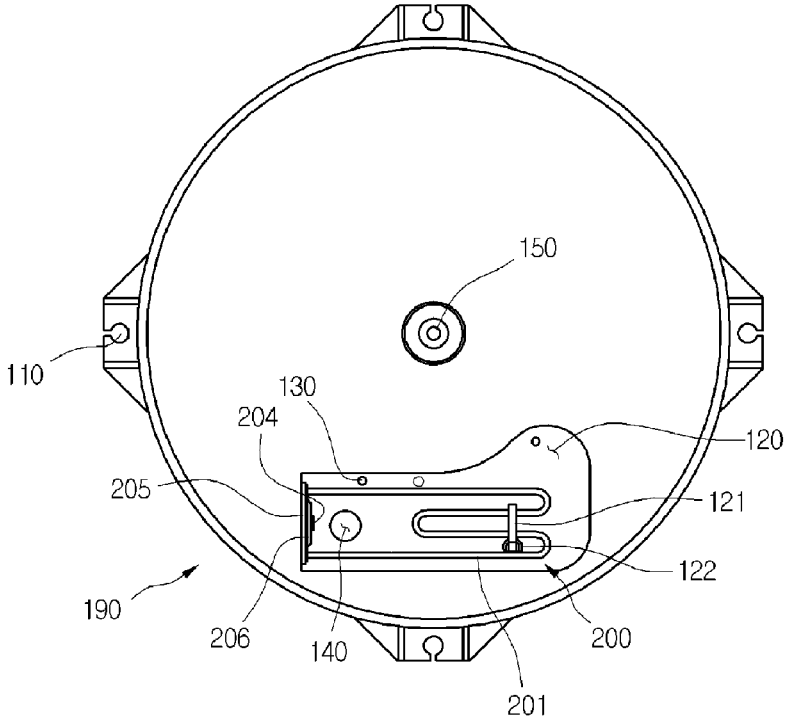
[Fig. 2]
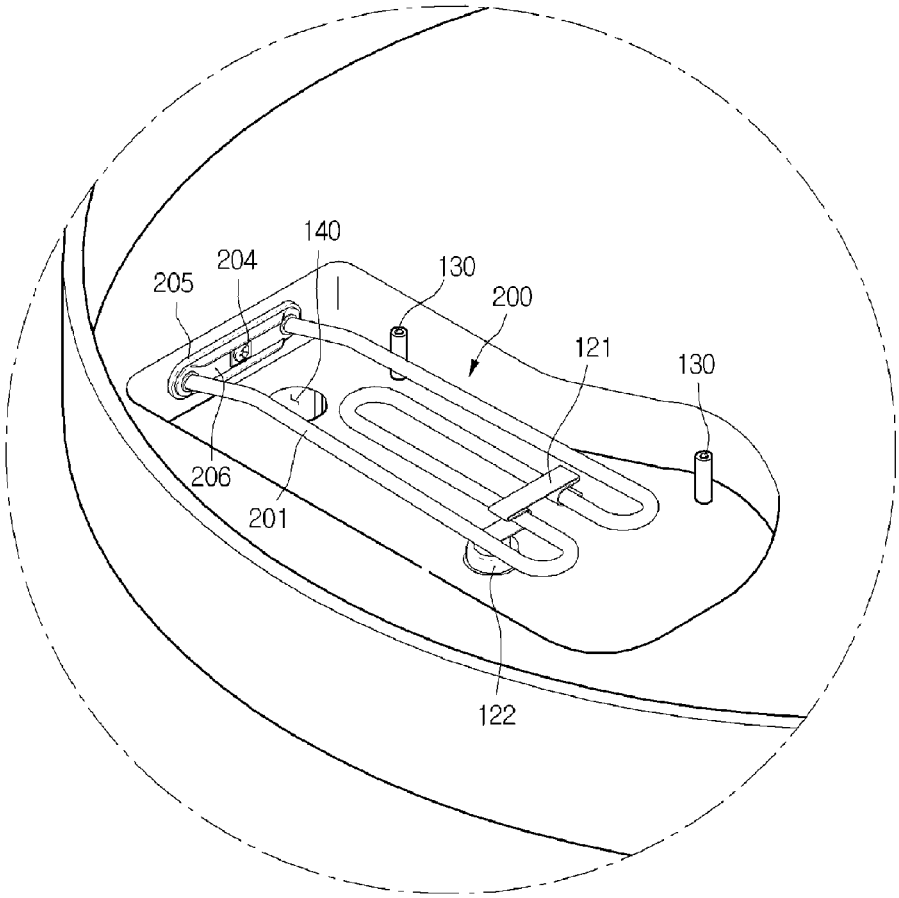

[Fig. 3]
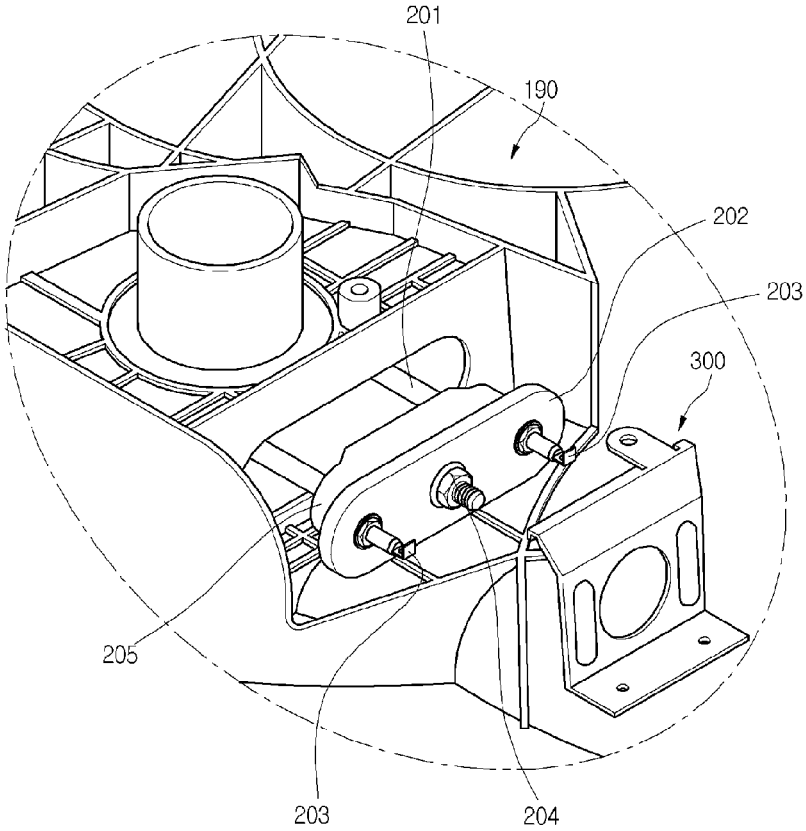
[Fig. 4]
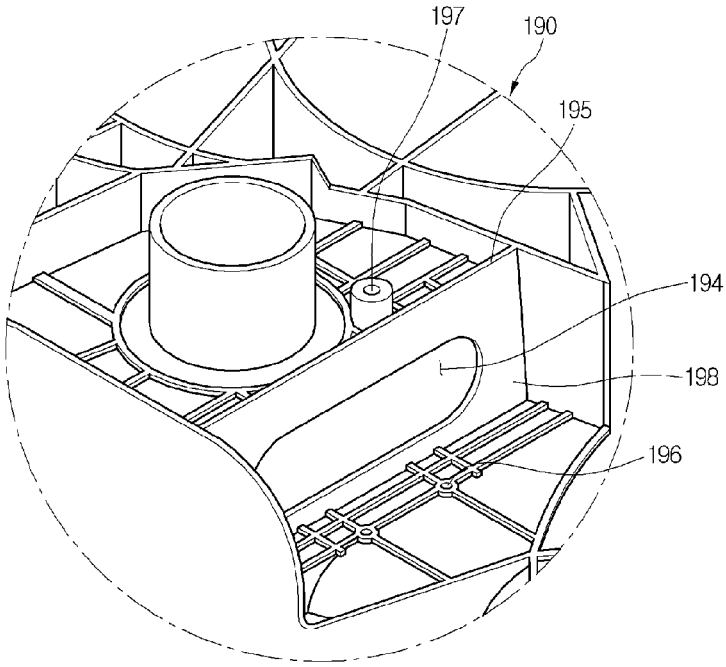

[Fig. 5]
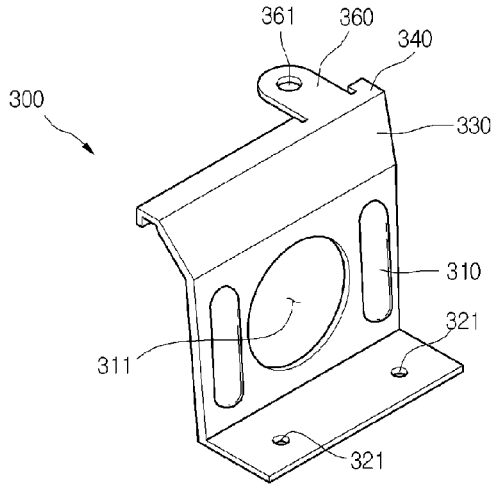
[Fig. 6]
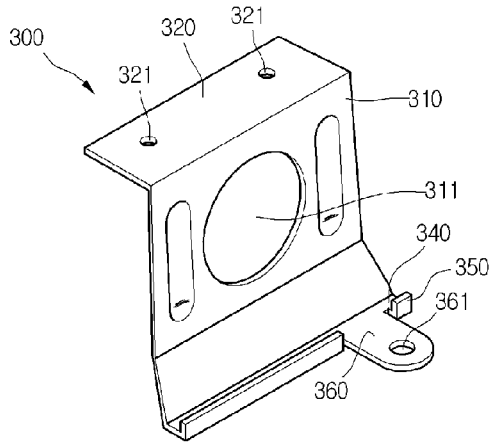
[Fig. 7]
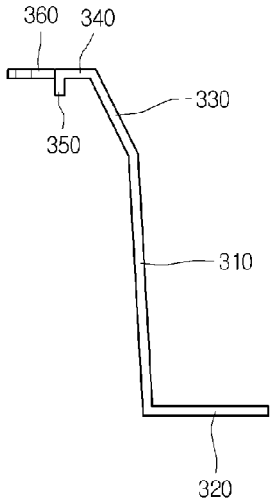

[Fig. 8]
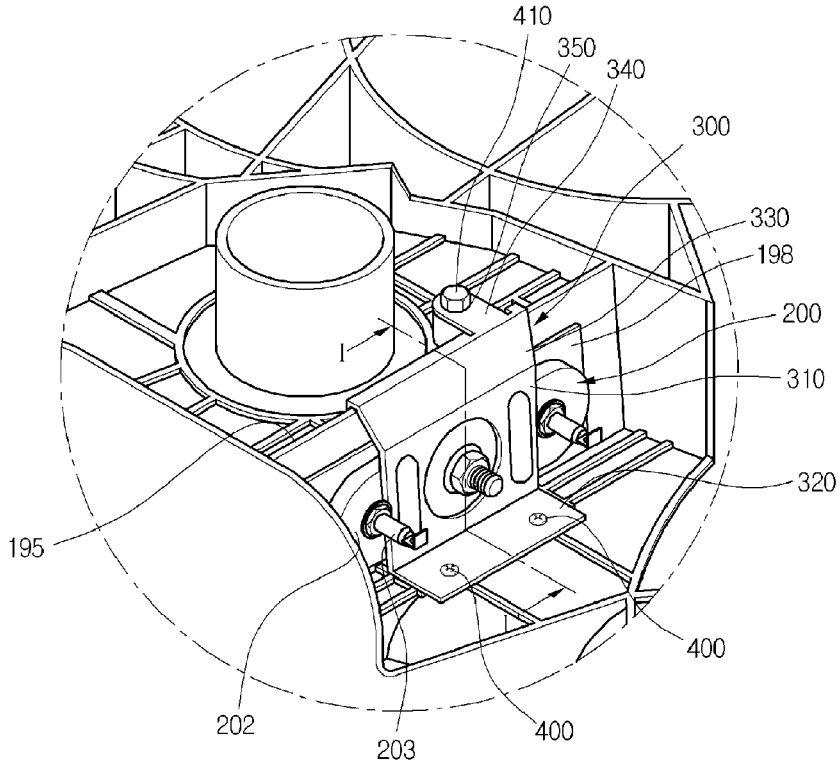
[Fig. 9]
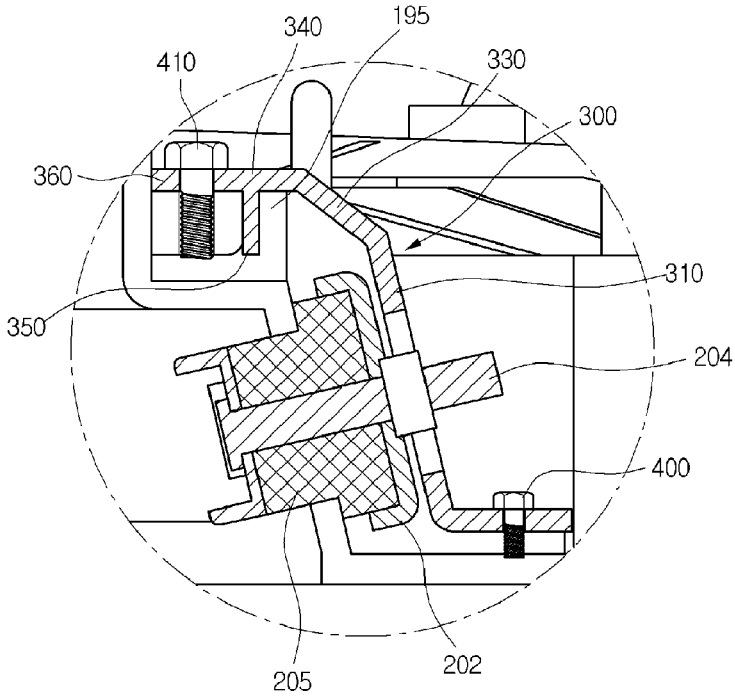

HEATER APPARATUS FOR WASHING MACHINE

TECHNICAL FIELD

The present invention is related to a washing machine.

BACKGROUND ART

In general, a tub is installed in the interior space of a cabinet which constitutes the external appearance of a washing machine. The tub is supported by a damper connected on the upper side of a tub, and stores the washing water in the interior. And, a laundry tray is installed rotatably in the interior of the tub. Particularly, as several opening are formed on the lower part and the flank of the laundry tray, the washing water stored in the tub flows between the laundry tray and the tub, and so the impurities are removed.

In another aspect, a heater which make the washing water hot as heating is installed on the bottom of the tub. Therefore, it isn't necessary to connect with a hot water dripping tap separately, because the washing water is heated as a certain temperature as a heater is operated, even if the cold water is flown into the interior of the tub in the winter.

The conventional technique on a tub having a heater which operates with the same as the above mentioned functions is recorded particularly on the official report of the Republic of Korean special permission licenses "10-2003-0055973."

However, generally a tub is an injection molded plastic that the strength is lower than a heater or a voltage. Therefore, according to the stress which occurred on the interior of the tub like the above-mentioned is continuously given, a crack is occurred on a part of the tub where the heater is united. In that case, the disadvantages like the product reliance is decreased greatly, etc as the washing water is leaked through the crack, etc are occurred.

DISCLOSURE OF INVENTION

Technical Problem

A purpose of the present invention is providing a heater apparatus of a washing machine which is able to prevent the occurrence of the cracks on a tub as improving the union structure which unites a tub with a heater

Technical Solution

An heater apparatus according to the present invention includes: a tub; a heater joint unit formed on the tub; a heater arranged on the heater joint unit; and a heater joint member being able to offset the pressure given to the heater joint unit according to the arrangement of the heater.

An heater apparatus according to another aspect of the present invention includes: a tub; a heater joint unit formed on the tub; a heater arranged on the heater joint unit; and a heater joint member including a heater pressurizing part which pressurizes the heater and the heater joint unit pressurizing part which pressurizes the heater joint unit.

An heater apparatus according to another aspect of the present invention includes: a tub; a heater joint unit formed on the tub; a heater arranged on the heater joint unit; and a heater joint member including at least two of the union parts which are united with the heater joint unit on the state where isolated each other with certain intervals.

ADVANTAGEOUS EFFECTS

According to an the heater apparatus according to the present invention, it is effective that a crack occurring circumstance on the union part of the tub is able to be prevented as a heater joint member is united with the tub.

Also, according to the heater apparatus, it is effective that a arrange condition is improved and a breakaway of a heater is able to be prevented as a heater joint member is able to pressurize the heater.

BRIEF DESCRIPTION OF THE DRAWINGS

FIG. 1 is a plane diagram showing the bottom of a tub having a heater according to the abstraction of the present invention.

FIG. 2 is a rear perspective view of the tub having a heater which is illustrated on FIG. 1.

FIG. 3 is a disassembled perspective showing a heater apparatus of a washing machine according to the abstraction of the present invention.

FIG. 4 is a perspective view showing a part of a tub used for the heater apparatus according to the abstraction of the present invention.

FIG. 5 is a front perspective view showing a heater joint member used for the heater apparatus of a washing machine according to the abstraction of the present invention.

FIG. 6 is a rear perspective view on a heater joint member illustrated on FIG. 5.

FIG. 7 is a side-view on a heater joint member illustrated on FIG. 5.

FIG. 8 is a united perspective view on the heater apparatus of a washing machine according to the abstraction of the present invention.

FIG. 9 is a verticaled cross-sectional view on the heater apparatus illustrated on FIG. 8.

BEST MODE FOR CARRYING OUT THE INVENTION

The concrete preferred embodiments of the present invention will be particularly explained with the drawings on the following. However, the abstraction of the present invention is not restricted to the preferred embodiment that the abstraction of the present invention is presented and other preferred embodiments included in the extents of other retrograded inventions or the abstraction of the present invention are able to be proposed easily according to an addition, alteration, and a deletion, etc.

FIG. 1 is a plane diagram showing the bottom of a tub having a heater according to the abstraction of the present invention; and FIG. 2 is a rear perspective view of the tub having a heater which is illustrated on FIG. 1.

To refer to the FIG. 1 to 2, the tub 190 of a washing machine according to the present invention is a cylinder-like shape having a prescribed diameter and height.

Particularly, the damper inserting groove 110 for a side of the end of a damper in order to be united with on a side of the tub 190 is formed. And a piercing groove for the washing axis 150 in order to be pierced on the center part. A heater arriving groove 120, or heater receiving groove 120, which is depressed as a prescribed form and depth for the heater 200 in order to be arrived safely on a lower side of the tub 190 is included.

Also, a drain-outlet 140 for the draining of the washing water is comprised on the bottom of the heater arriving groove 120, and at least one of the heater cover conclusion boss 130 which is formed as protruded on the edge of the heater arriving groove 120 with a prescribed height is comprised.

Also, a thermostat 122 which perceives whether the heater 200 is overheated or not is installed on a side of the heater arriving groove 120, and a clamp 121 which fixes the heater is installed on the upper part of the thermostat 122.

Also, an inserting hole 194 for the heater 200 in order to be inserted is formed on the lower part of the tub 190. Particularly, to prevent permeating of the moisture and washing water into the terminal unit of the heater 200, the inserting hole 194 is formed as depressed with a prescribed depth.

Also, a heater 200 placed on the heater arriving groove 120 is formed with a prescribed diameter and length, and comprises: and a heater pipe 201 which is crooked several times on a prescribed state; a power connecting unit 203, or power terminal, which is formed on the both ends of the heater pipe 201, and approves the power as being connected convertibly with the heater pipe 201.

Also, on the heater 200, a sealing member 205 is inserted through the power connecting unit 203. And, before the sealing member is inserted a keeping plate 206 which pressurizes the sealing member 205 is inserted previously. And on the back side of the sealing member, a sealing case 202 which is depressed with a prescribed depth for a safe arriving of the sealing member 205, and for preventing the leakage of the washing water from the heater inserting hole 194 is inserted. In this part, the sealing case 202 is strongly closed on the external wall of the tub 190 by the straining member which will be mentioned later.

On the other hand the keeping plate 206 and the sealing case 202 are strongly tightened by the assembly joint member 204, or fastener 204, which passes through the middle of the keeping plate 206. In this part, a material having a prescribed elastic force and flexibility is used for the sealing member 205, desirably, the quality of a rubber can be used.

More particularly, the sealing member 205 is inserted easily into the inner part of the heater inserting hole 194 as the shape is formed the same or a little smaller than the heater inserting hole 194. However, the thickness of the sealing member 205 is formed thicker than the thickness of the tub 190.

In this part, if a compressive force is inflicted to the sealing member 205 by the assembly joint member 204, the upper aspect part of the sealing member 205 is spreaded to the endostyle surface of the tub 190 as illustrated. And, the square measure of the sealing member 205 is spreaded wider than the square measure of the heater inserting hole 194. Therefore, the situation that the washing water is leaked to the heater inserting hole 194 is cleared as the sealing member is spreaded laterally by the compressive force and seals the heater inserting hole 194 completely.

On the other hand the heater pipe 201 of the heater 200 is an electric conductor having a prescribed diameter and length as mentioned above, and formed as being crooked several times. In this part, the length and the number of the bending times, etc of the heater pipe 201 can be decided to be bended according to the required length of the heater pipe.

FIG. 3 is a disassembled perspective showing a heater apparatus of a washing machine according to the abstraction of the present invention.

To refer to the FIG. 3, the heater 200 union structure of the tub 100 according to the present invention is having a heater 200 which is able to heat the washing water in the inner part of the tub 100, a tub 190 that the heater 200 is inserted and a heater joint member 300, or heater bracket 300, fixes the heater 200 to the tub 190.

The heater is having a heater pipe 201 which beats the washing water as directly touched with the washing water, a sealing case 202 which is formed on the end part of the heater pipe 201, and a sealing member 205 which seals the interval of between the heater 200 and the tub 190. The power connecting unit 203, or power terminal 203, which is connected with a prescribed power is formed on the end part of the heater pipe 201. The heater 200 is able to be a single item that a sealing case 202, heater pipe 201, and a sealing member 205 are combined by the assembly members like the extra bolts, etc.

On the other hand, according to the present invention, the heater 200 is fixed as a part of the heater joint member 300 is hitched on a prescribed part of the tub 190 and combined on the tub 190. As the above-mentioned the heater 200 isn't united directly with the tub 190 as using the bolts, etc, but united indirectly by the heater joint member 300, so the crack which is able to be occurred by the union of the tub and the heater 200 can be prevented.

FIG. 4 is a perspective view showing a part of a tub used for the heater apparatus according to the abstraction of the present invention.

To refer to the FIG. 4, on the tub 190 according to the present invention, the confrontation part 198 which is confronted with the sealing case 202 of the heater 200, and the heater inserting hole 194 which is formed on the confrontation part 198 and the heater 200 is inserted are formed And, the hitch rib 195 formed on the upper side of the heater inserting hole 194, and a No. 1 joint member inserting hole 197, or first fastening hole 197, and a No. 2 joint member inserting hole 196, or second fastening hole 196, for fixing of the joint member 300 like the bolts, etc, are formed on the tub 190.

In this part, the heater inserting hole 194, the hitch rib 195, and the confrontation part 198 are some of the preferred embodiments showing the part for the heater to be united. Besides, the various embodiments for the part that the heater 200 is able to be united can be supposed, and the part can be defined as a heater joint unit.

The hitch rib 195 is as a protruded part with a prescribed height on the upper side of the heater inserting hole 194, the hook 350 of FIG. 5 of the heater joint member 300 is hitched on it. The part of the tub 190 that the hitch rib 195 is formed is a part that the crack occurrence rate is high. In the present invention, as the heater 200 is united as a hitching method using the hitch rib 195, the crack occurrence rate is able to be declined.

FIG. 5 is a front perspective view showing a heater joint member used for the heater apparatus of a washing machine according to the abstraction of the present invention, FIG. 6 is a rear perspective view on a heater joint member illustrated on FIG. 5, and FIG. 7 is a side-view on a heater joint member illustrated on FIG. 5.

To refer to the FIG. 5 to 7, a lower part unit 320, or first flange 320, a pressurizing unit 310, or pressurizing plate 310, an incline part unit 330, or inclined second flange 330, including a rib confrontation unit 340, and a hook 350 are formed on the heater joint member 300 according to the present invention.

The lower part unit 320 and the hook 350 are able to be declined as a heater joint unit pressurizing unit to be confronted with the heater pressurizing unit 310.

The lower part unit 320 is a part which is united with the tub 190. The union like the above-mentioned cab be accomplished by the extra joint members like bolts and etc, and for this, the No. 2 joint member inserting hole 321 is able to be formed. It is desirable that the No. 2 joint member inserting hole 321 are formed as several figures in order, to increase the union reliability.

The heater pressurizing unit 310 is a part that the heater is able to be fixed indirectly on the tub 190 as pressurizing the heater 200 from the rear part of the heater. In this preferred embodiment, the heater pressurizing unit 310 is formed as a structure which pressurizing the sealing case 202 of the heater 200. And, a center hole 311 for inserting the assembly joint member 204 of the heater 200 is formed nearly the center of the heater pressurizing unit 310.

The rib confrontation unit 340 is a part that the lower part of it is confronted with the hitch rib 195.

The hook 350 is formed as bended on the rib confrontation unit 340, and surface contacted on the hitch rib 195 with the rib confrontation unit 340 as hitched on the hitch rib 195.

As formed like the above-mentioned the heater joint member 300 and the tub 190 are united directly, and because of that, the heater 200 and the tub 190 are united indirectly. Therefore, the crack of the tub 190 occurred as a result of the direct union of the heater 200 is able to be prevented.

On the other hand on the heater joint member 300, a supporting joint unit 360, or support flange 360, is able to be formed to increase the union reliability as supporting the union of the hook 350. In the present preferred embodiment, the supporting joint unit 360 is formed as protruded with a prescribed length on the rib confrontation unit 340, and in the inner part of it, a No. 1 joint member inserting hole 361, or first fastener inserting hole 361, is formed. The extra joint member like bolts and etc are able to be contracted on the No. 1 joint member inserting hole 361.

FIG. 8 is a united perspective view on the heater apparatus of a washing machine according to the abstraction of the present invention, and FIG. 9 is a verticaled cross-sectional view on the heater apparatus illustrated on FIG. 8.

To refer to the FIGS. 8 and 9 together, the heater 200 union structure according to the present invention is possesses the extra heater joint member 300, or heater bracket 300, for the heater 200 to be united with the tub 190. Because the part on the heater joint member 300 and the tub 190 were explained above already, the duplicated explanations will be omitted from here and replace with the above-explained.

As illustrated on the present invention, the heater 200 is inserted on the heater inserting hole 194, after that, the heater joint member 300 make the heater 200 adhere closely by pressurizing. And, the hook 350 formed on the upper part of the heater joint member 300 is hitched on the hitch rib 195 formed on the tub 190, and the heater joint member 300 is contract and fixed on the tub 190 as the joint members like, bolts and etc are contracted on the No. 2 joint member inserting hole 321, or second fastener inserting hole 321, which is formed on the lower part unit 320 of the heater joint member 300. Then, the heater joint member 300 pressurizes the heater 200, and the heater 200 is fixed on against with the tub 190.

On the other aspect of the present invention, as the heater joint member 300 is united on the tub 190, the heater joint member 300 pressurizes the heater joint unit by the union force. Then, as the heater 300 is installed on the heater joint unit, the pressure which is inflicted to the heater joint unit by the installing of the heater 300 is able to be offset by the pressure which is inflicted by the heater joint member 300. Therefore, the situation that the crack is occurred on the heater joint unit of the tub 190 according to the installing of the heater 200.

The heater joint member 300 is able to pressurize the heater 200 with the heater joint unit or independently. Then, the arrangement condition of the heater 200 is improved and the breaking away of the heater 200 is able to be prevented.

On the other hand the heater joint members are united on the both sides of the heater 200 which is placed between them. Particularly, a hook is formed on a side of the heater joint member 300, and hitched on the hitch rib 195 of the tub 190 on a side of the heater 200. And a lower part unit 320 is formed on another side of the heater joint member 300, and united on another side of the heater 200 by the tub 190. Then, as the heater joint members 300 are united on the both sides of the heater 200 which is placed between them, arrange the heater as pressurizing the heater 200, and prevent the breaking away of the heater 200. And, prevents the occurrence of the crack of the tub 190 as pressurizing the heater joint unit where the heater 200 is installed.

INDUSTRIAL APPLICABILITY

According to the heater apparatus which is constituted like the above-mentioned in accordance with the present invention, the industrial applicability is high as the durability of a washing machine and the reliability of a product are improved as the crack which was occurred on the tub because of the union of the heater is prevented.

The invention claimed is:

1. A heater apparatus of a washing machine, comprising:
- a tub;
- a heater receiving groove recessed in an interior bottom surface of the tub;
- a heater received in the heater receiving groove; and
- a heater bracket that couples the heater to the tub, wherein the heater bracket is directly fixed to an exterior surface of the tub so as to indirectly couple the heater to a corresponding interior surface of the tub within the heater receiving groove, the heater bracket comprising:
  - a pressurizing plate;
  - a center hole formed in the pressurizing plate that receives a fastener therethrough that rigidly couples the heater to the heater bracket;
  - a first flange that extends outward from a first edge of the pressurizing plate;
  - a second flange that extends outward from a second edge of the pressurizing plate opposite the first edge thereof;
  - a hook formed along a peripheral edge of the second flange;
  - a support flange that extends outward from the peripheral edge of the second flange; and
  - fastener inserting holes formed in the support flange and the first flange, wherein the fastener inserting holes respectively receive fasteners therethrough that rigidly couple the heater bracket to the tub.

2. The heater apparatus of a washing machine according to claim 1, wherein the heater bracket offsets pressure applied to the tub due to the coupling of the heater thereto based on a coupling force between the heater bracket and the tub.

3. The heater apparatus of a washing machine according to claim 1, wherein the heater bracket offsets pressure applied to the tub due to the coupling of the heater thereto to both the exterior surface of the tub and the corresponding interior surface of the tub.

4. The heater apparatus of a washing machine according to claim 1, wherein the heater bracket offsets pressure applied to the tub due to the coupling of the heater thereto in at least in two directions.

5. The heater apparatus of a washing machine according to claim 1, wherein the hook engages a corresponding rib formed on the exterior surface of the tub.

6. The heater apparatus of a washing machine according to claim 1, wherein the heater comprises:
- a casing received in a heater receiving hole formed in the bottom surface of the tub so as to receive the heater therethrough and position the heater in the heater receiving groove;

heater pipes extending in a first direction from the casing;

power connection terminals extending in a second direction from the casing; and a sealing member provided at an outer peripheral portion of the casing so as to form a seal between the casing and the heater receiving hole.

7. The heater apparatus of a washing machine according to claim 6, wherein the pressurizing plate of the heater bracket is pressed against a corresponding surface of the casing such that the heater bracket presses against the casing when the fastener rigidly couples the heater bracket to the casing of the heater.

8. A heater apparatus of a washing machine, comprising:

a tub;

a heater receiving groove formed as a recess in an interior surface of the tub;

a heater received in the heater receiving groove; and a heater bracket fixed to a corresponding exterior surface of the tub so as to couple the heater to the tub and fix a position of the heater in the heater receiving groove, the heater bracket including:

a pressurizing plate that applies coupling pressure to an exposed surface of a casing of the heater; and first and second coupling flanges that respectively extend from opposite edges of the pressurizing plate, the first and second coupling flanges being oriented in different directions with respect to the pressurizing plate, wherein the pressurizing plate and the first and second coupling flanges are formed as a single unit, and wherein the first and second coupling flanges are coupled to corresponding portions of the exterior wall of the tub so as to directly fix the heater bracket to the tub and fix a position of the heater in the heater receiving groove.

9. The heater apparatus of a washing machine according to claim 8, wherein the first coupling flange comprises a hook that engages a corresponding rib formed on the exterior wall of the tub, and the second coupling flange comprises a plurality of holes having a corresponding plurality of fasteners extending therethrough and into a corresponding plurality of bosses formed in the exterior wall of the tub so as to directly fix the heater bracket to the tub and fix the position of the heater in the heater receiving groove.

* * * * *